US008944975B2

(12) United States Patent
Hsieh

(10) Patent No.: US 8,944,975 B2
(45) Date of Patent: Feb. 3, 2015

(54) APPARATUS FOR EXERCISE, BODY BUILDING AND REHABILIATION

(71) Applicant: Sheng-Hsu Hsieh, Tainan (CN)

(72) Inventor: Sheng-Hsu Hsieh, Tainan (CN)

(73) Assignee: Li-Hsia Liu, Tainan (TW)

( * ) Notice: Subject to any disclaimer, the term of this patent is extended or adjusted under 35 U.S.C. 154(b) by 63 days.

(21) Appl. No.: 13/664,390

(22) Filed: Oct. 30, 2012

(65) Prior Publication Data

US 2014/0121077 A1 May 1, 2014

(51) Int. Cl.
*A63B 21/02* (2006.01)

(52) U.S. Cl.
USPC ..... 482/124; 482/126

(58) Field of Classification Search
USPC ..... 482/92, 121–126
See application file for complete search history.

(56) References Cited

U.S. PATENT DOCUMENTS

| | | | | | |
|---|---|---|---|---|---|
| 2,930,614 | A * | 3/1960 | McIntosh | 482/126 |
| 3,427,023 | A * | 2/1969 | Silberman | 482/139 |
| 3,528,656 | A * | 9/1970 | Karl-Theodor | 482/139 |
| 4,685,671 | A * | 8/1987 | Hagerman et al. | 482/124 |
| 5,505,677 | A * | 4/1996 | Hinds | 482/10 |
| 5,549,532 | A * | 8/1996 | Kropp | 482/126 |
| 5,665,040 | A * | 9/1997 | Ho | 482/126 |
| 5,885,196 | A * | 3/1999 | Gvoich | 482/125 |
| 5,894,631 | A * | 4/1999 | Chiu | 16/110.1 |
| 6,071,217 | A * | 6/2000 | Barnett | 482/121 |
| 6,151,758 | A * | 11/2000 | Chiu | 16/443 |
| 6,348,026 | B1 * | 2/2002 | Kuo | 482/126 |
| 6,497,641 | B1 * | 12/2002 | Hinds | 482/126 |
| 6,663,544 | B2 * | 12/2003 | Hinds | 482/126 |
| 6,676,576 | B1 * | 1/2004 | Wu | 482/126 |
| 6,692,415 | B1 * | 2/2004 | Winston | 482/126 |
| 7,377,886 | B2 * | 5/2008 | Wu | 482/126 |
| 7,578,775 | B2 * | 8/2009 | Terry | 482/126 |
| 8,152,703 | B1 * | 4/2012 | Hinds et al. | 482/122 |
| 2002/0052270 | A1 * | 5/2002 | Hinds | 482/126 |
| 2004/0259702 | A1 * | 12/2004 | Tung | 482/126 |
| 2005/0075223 | A1 * | 4/2005 | Wu | 482/126 |
| 2005/0176562 | A1 * | 8/2005 | Huang | 482/121 |
| 2006/0105893 | A1 * | 5/2006 | Chen | 482/126 |
| 2007/0015643 | A1 * | 1/2007 | Kung | 482/126 |
| 2007/0042881 | A1 * | 2/2007 | Wu | 482/126 |
| 2008/0300117 | A1 * | 12/2008 | Madden | 482/126 |
| 2009/0253562 | A1 * | 10/2009 | Yang | 482/126 |
| 2013/0288864 | A1 * | 10/2013 | Holland | 482/126 |

* cited by examiner

*Primary Examiner* — Stephen Crow
*Assistant Examiner* — Garrett Atkinson
(74) *Attorney, Agent, or Firm* — J.C. Patents

(57) ABSTRACT

An apparatus for exercise, body building and rehabilitation includes a main body to be grasped by a user or bound around a proper part of a user's body. A fixing member is secured with the main body for fixing one end of an elastic rope, loop-shaped and provided with a first and a second end portion in proper proportion. The first end portion is formed with an open hole extending downward and contracting gradually to form a longer open hole at the second end portion. The elastic rope has one end head first put in the larger open hole of the first end portion and then the elastic rope is moved downward to force its end head to be stuck in the narrower open hole of the second end portion of the fixing member not to slip off, facilitating a user to carry out exercise, body building or rehabilitation.

11 Claims, 9 Drawing Sheets

APPARATUS FOR EXERCISE, BODY BUILDING AND REHABILIATION

BACKGROUND OF THE INVENTION

1. Field of the Invention

This invention relates to an apparatus for exercise, body building and rehabilitation, particularly to one provided with a main body, a fixing member and elastic ropes that respectively have one end secured with the fixing member and restricted not to slip off, enabling a user to freely replace the elastic rope or increase the number of the elastic ropes and facilitating to be operated for carrying out various exercises a user needs.

2. Description of the Prior Art

A first conventional dragrope body-building apparatus, as shown in FIG. 1, is provided with an elastic dragrope 1 having one end fixed with a holding grip 2 formed with an endless body 20 bored with a fitting hole 201 for the elastic dragrope 1 to be inserted therein. After one end of the elastic dragrope 1 is inserted through the fitting hole 201 of the holding grip 2, this end of the dragrope 1 is secured with a stop member 11 whose diameter is larger than that of the fitting hole 201 so as to stop the end of the elastic dragrope 1 from withdrawing out of the fitting hole 201 for firmly combining the elastic dragrope 1 together with the holding grip 2. The drawback of the first conventional dragrope body-building apparatus is that it is hard to replace the elastic dragrope 1 and impossible to increase the number of the elastic dragropes 1, failing to freely replace the elastic dragrope 1 in accordance with a user's sports habitual nature and lacking elasticity in use.

A second traditional dragrope body-building apparatus, as shown in FIG. 2, includes a plurality of elastic dragropes 3 respectively having a first end head 31 firmly combined with a stop member 33 whose diameter is larger than that of the dragrope 3, and a positioning unit 4 made of two positioning plates 41, 42 with a same structure and characteristic, and each positioning plate 41, 42 is bored with a plurality of positioning holes 411, 421 for the dragropes 3 to be respectively inserted therein. A fixed member 5 is provided for securing the positioning unit 4 thereon, and a binding belt 51 is inserted through the fixed member 5 and has two ends fixed with the two positioning plates 41 and 42 and further a holding grip 52 is fitted on the binding belt 51 to be grasped by a user. However, the positioning unit 4 of the second conventional dragrope body-building apparatus for securing one end of the elastic dragrope 3 is likely to be twisted and deformed in case a user drags the elastic dragrope 3 with too large a force, thus resulting in misgivings of safety in use.

SUMMARY OF THE INVENTION

The objective of this invention is to offer an apparatus for exercise, body building and rehabilitation, provided with a main body able to be directly combined with a proper part of a user's body, and a fixing member for securing one end of an elastic rope that can be freely adjusted in number and strength.

The main body of this invention can be grasped by a user or bound around a proper part of a user's body, and the fixing member secured with the main body can be only a single one or plural ones, depending on practical needs.

The fixing member is loop-shaped, formed with a first end portion and a second end portion in proper proportion. The first end portion is provided with an open hole extending downward and contracting by degrees to form another open hole at the second end portion, which is longer than the open hole at the first end portion. Thus, when one end head of the elastic rope is to be combined with the open hole at the second end portion of the fixing member, this end head has to be first put in the open hole at the first end portion and then the elastic rope is moved downward to force the end head to get in the narrower open hole at the second end portion and stuck therein not to slip off, thus enabling a user to drag the elastic rope for carrying exercise, body building and rehabilitation.

BRIEF DESCRIPTION OF DRAWINGS

This invention will be better understood by referring to the accompanying drawings, wherein.

DETAILED DESCRIPTION OF THE PREFERRED EMBODIMENT

A first, a second and a third preferred embodiment of an apparatus for exercise, body building and rehabilitation in the present invention, as shown in FIGS. 3-6, includes a main body 1, one or more fixing members 2 and one or more elastic ropes 4 as main components combined together.

Figure 1:
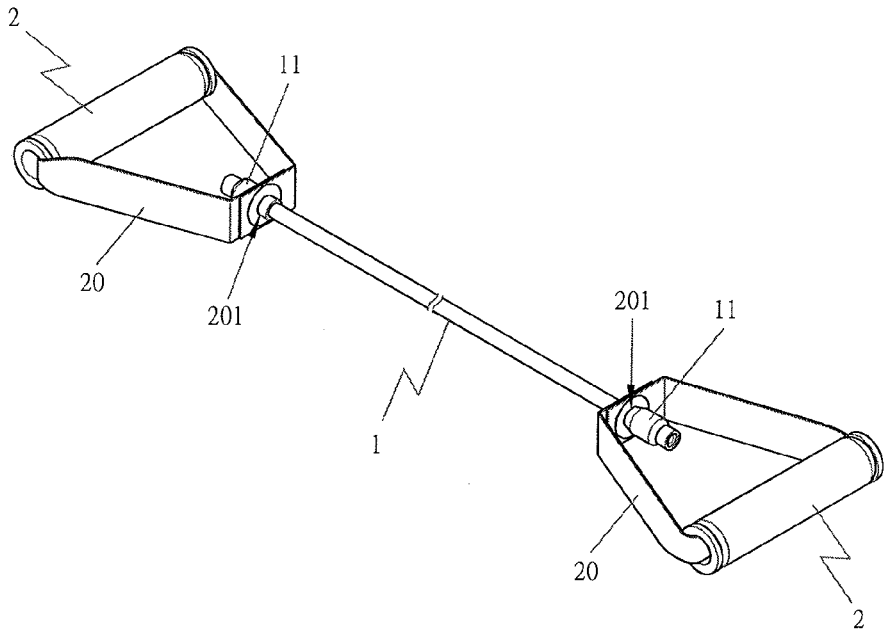
FIG 1 (PRIOR ART)
FIG. 1 is a perspective view of a first conventional dragrope body-building apparatus.
Figure 2:
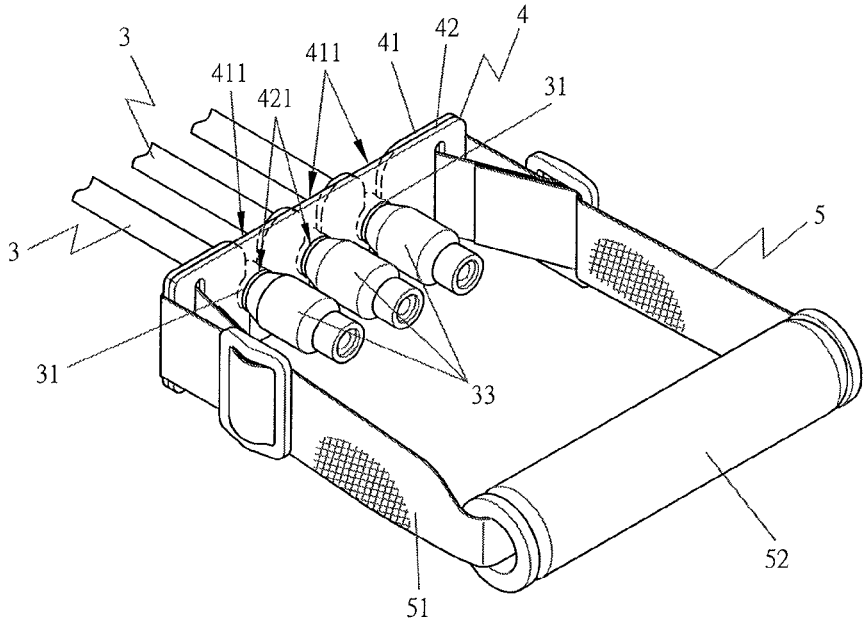
FIG 2 (PRIOR ART)
FIG. 2 is a perspective view of a second conventional dragrope body-building apparatus.
Figure 3:
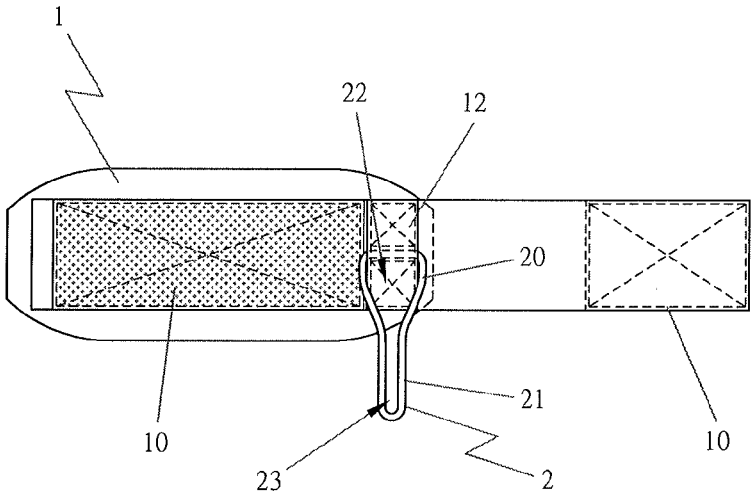
FIG. 3 is a schematic view of a first preferred embodiment of an apparatus for exercise, body building and rehabilitation in the present invention.

The main body 1 is to be grasped by a user or firmly bound around a proper part of a user's body. If the main body 1 is to be combined with a user's wrist, as shown in FIG. 3, the main body 1 is an annular belt having two ends respectively provided with a combining member 10, such as a Velcro band, to be combined with each other. Thus, the main body 1 can be freely adjusted in tightness to be bound around a user's wrist according to the size of the user's wrist. The main body 1 is further disposed with one or plural fixing members 2.

Figure 4:
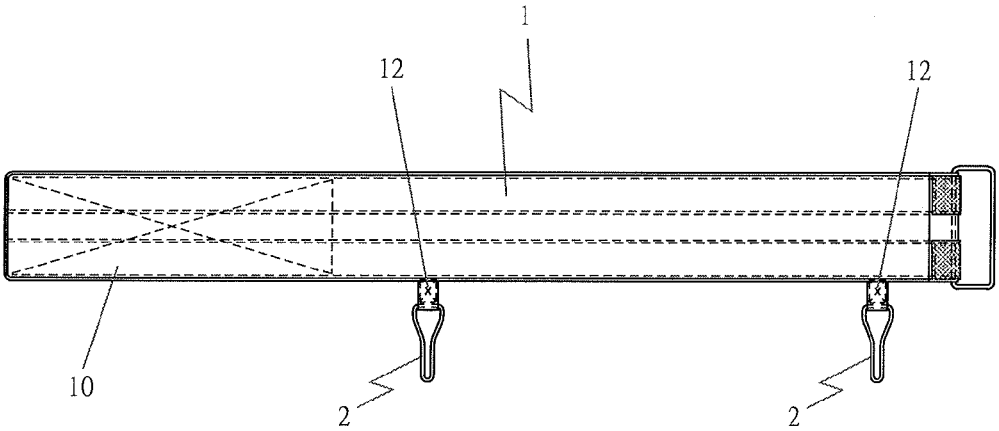
FIG. 4 is a schematic view of a second preferred embodiment of the apparatus for exercise, body building and rehabilitation in the present invention.
Figure 5:
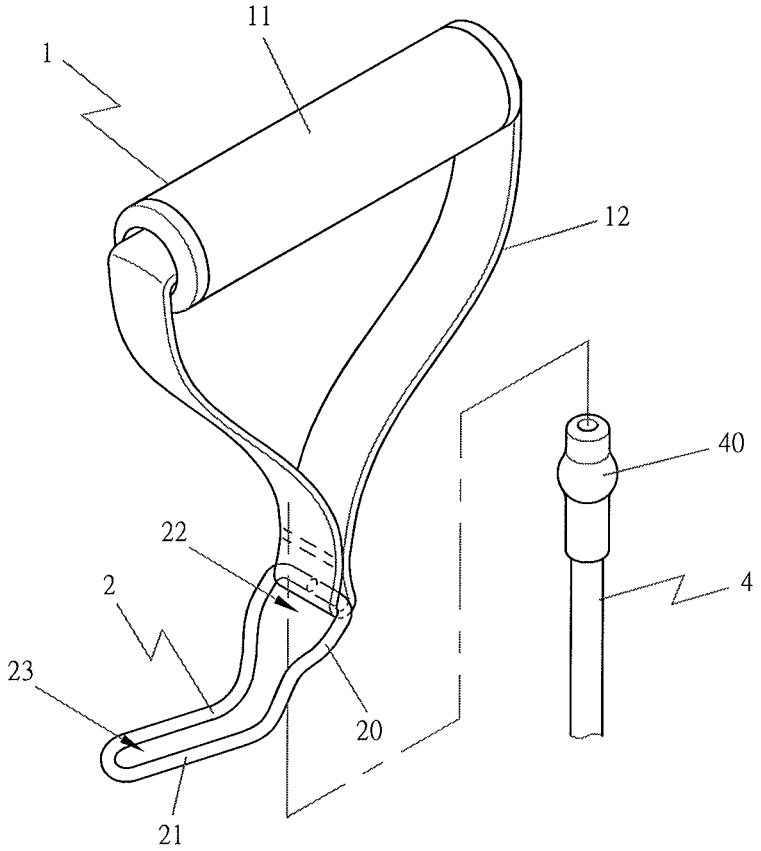
FIG. 5 is a partial exploded perspective view of a third preferred embodiment of the apparatus for exercise, body building and rehabilitation in the present invention.

The main body 1 is widened and lengthened if the main body 1 is to be bound around a user's waist, as shown in FIG. 4. The main body 1 is provided with appropriate combining members 10 and a plurality of fixing members 2.

Figure 6:
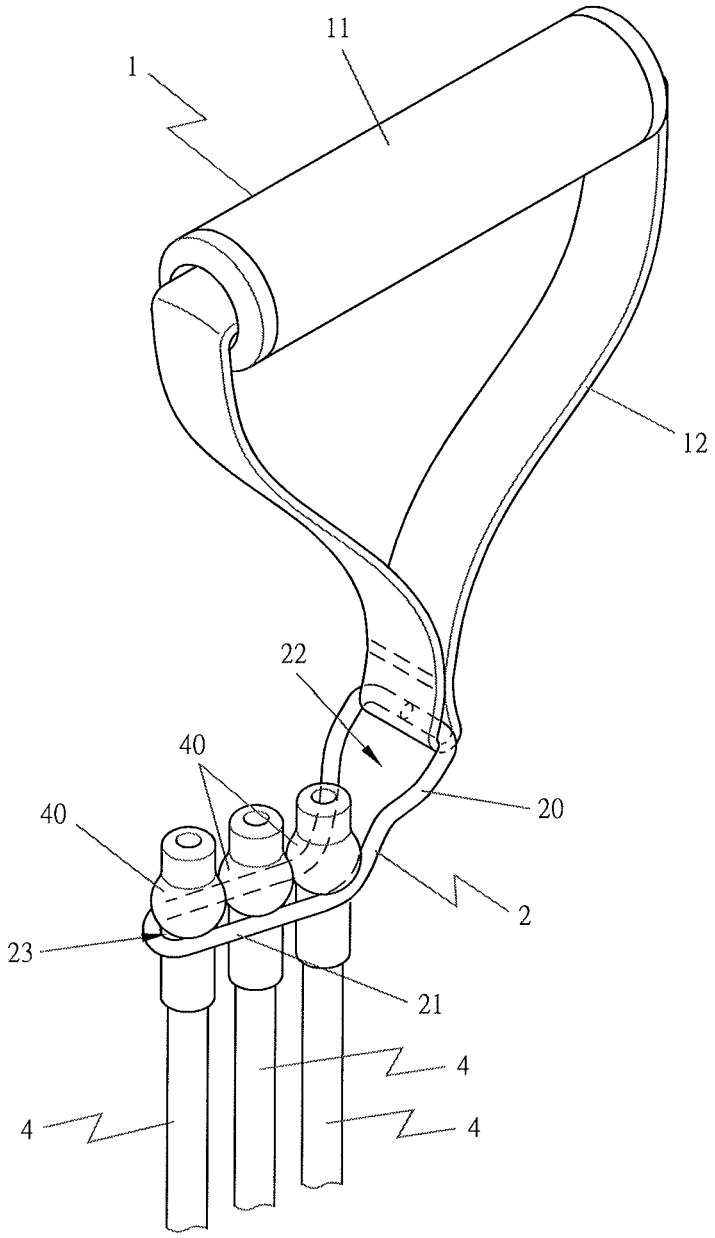
FIG. 6 is a perspective view of the third preferred embodiment of the apparatus for exercise, body building and rehabilitation in the present invention.

The main body 1 is provided with a holding grip 11 and a single fixing member 2, as shown in FIG. 6, in case the main body 1 is to be grasped by a user's hand.

Figure 7:
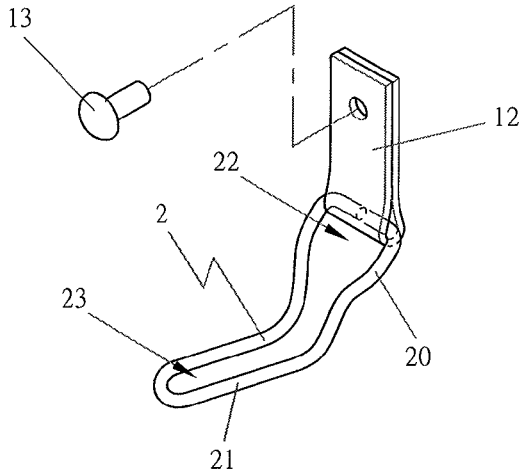
FIG. 7 is a perspective view of another preferred embodiment of a connecting member of the apparatus for exercise, body building and rehabilitation in the present invention.
Figure 8:
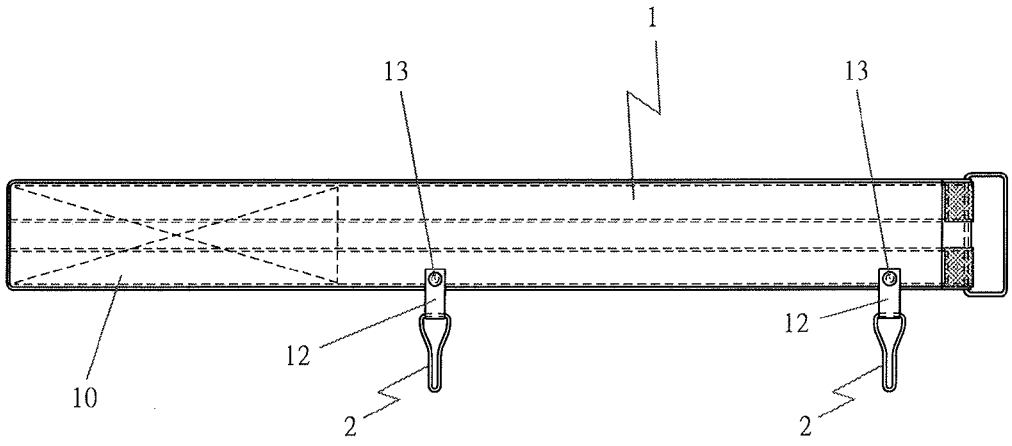
FIG. 8 is a schematic view of a fourth preferred embodiment of the apparatus for exercise, body building and rehabilitation in the present invention.
Figure 9:
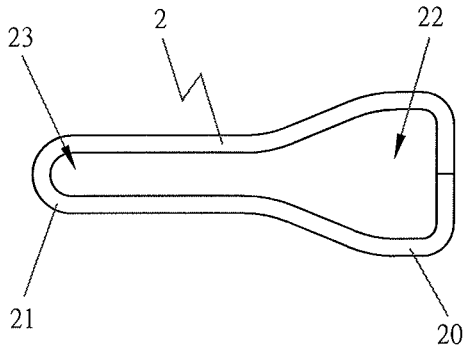
FIG. 9 is an upper view of a fixing member of the apparatus for exercise, body building and rehabilitation in the present invention.
Figure 10:
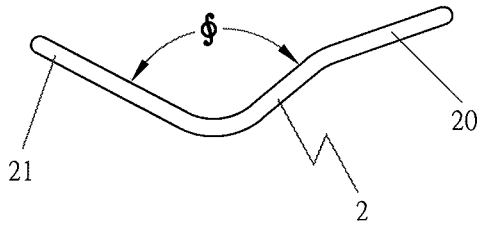
FIG. 10 is a side view of the fixing member of the apparatus for exercise, body building and rehabilitation in the present invention.
Figure 11:
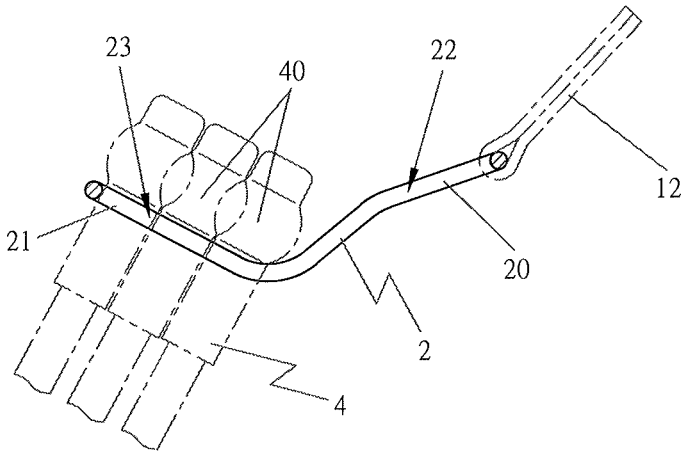
FIG. 11 is a schematic view of combination of the fixing member with elastic ropes in the present invention.

Preferably, a connecting member 12 is provided to serve as a connection medium for connecting the fixing member 2 with the main body 1. Of course, it also will do if no connecting member 12 is provided so long as the fixing member 12 can be firmly combined with the main body 1. The connecting member 12 can be made of every sort of material to be combined with the main body 1 by sewing, as shown in FIGS. 3-6, or made of a metal fastener to be riveted together with the main body 1 by means of a rivet 13; therefore, the connecting member 12 is not restricted in form and material so long as it can be employed for connecting the main body 1 together with the fixing member 2, as shown in FIGS. 7 and 8.

The fixing member 2 loop-shaped and formed into an irregular geometrical shape is made of metallic material or of non-metallic material with proper strength. The fixing member 2 is provided with a first end portion 20 and a second end portion 21 in proper proportion, with an included angle § formed between the first end portion 20 and the second end portion 21 for enhancing the structural strength of the fixing member 2 and enabling an elastic rope 4 to droop naturally when the elastic rope 4 is combined with the fixing member 2. Preferably, the included angle § of the fixing member 2 is larger than 90 degrees and less than 175 degrees. Of course, there can be provided with no included angle between the first end portion 20 and the second end portion 21 of the fixing member 2, that is, the § is equal to zero degree, so long as the structure of the fixing member 2 is strong enough, and the elastic rope 4 can be fixedly combined with the fixing member 2.

The first end portion 20 of the fixing member 2 is formed with an open hole 22 extending downward and contracting gradually to form a narrower open hole 23 at the second end portion 21, and the open hole 23 of the second end portion 21 can be equal to, or longer than or shorter than the open hole 22 of the first end portion 20 in length.

The open hole 23 at the second end portion 21 of the fixing member 2 is for fixing and positioning one end head 40 of the elastic rope 4. To have the end head 40 of the elastic rope 4 combined with the narrower open hole 23 of the second end portion 21 of the fixing member 2, only have the end head 40 of the elastic rope 4 inserted through the larger open hole 22 of the first end portion 20 and then move the elastic rope 4 downward to actuate the end head 40 of the elastic rope 4 to get in the narrower open hole 23 of the second end portion 21 of the fixing member 2 and be stuck therein not to slip off, convenient for a user to drag the elastic rope 4 and carry out what exercise he needs. In addition, the open hole 23 of the second end portion 21 of the fixing member 2 can be combined with one single or plural elastic ropes 4. The elastic ropes 4 can be freely adjusted in number by a user in accordance with practical needs of gravity exercise, body building or rehabilitation.

Figure 12:
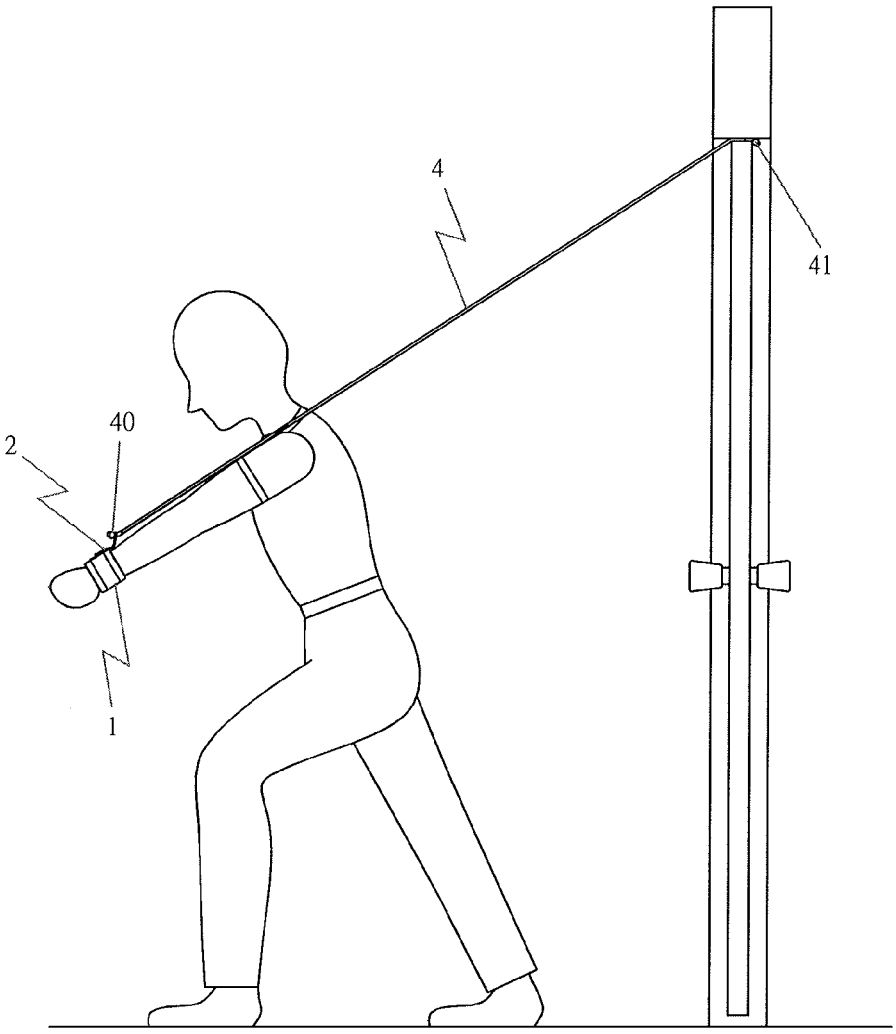
FIG. 12 is a schematic view of the apparatus for exercise, body building and rehabilitation in a first using condition in the present invention.
Figure 13:
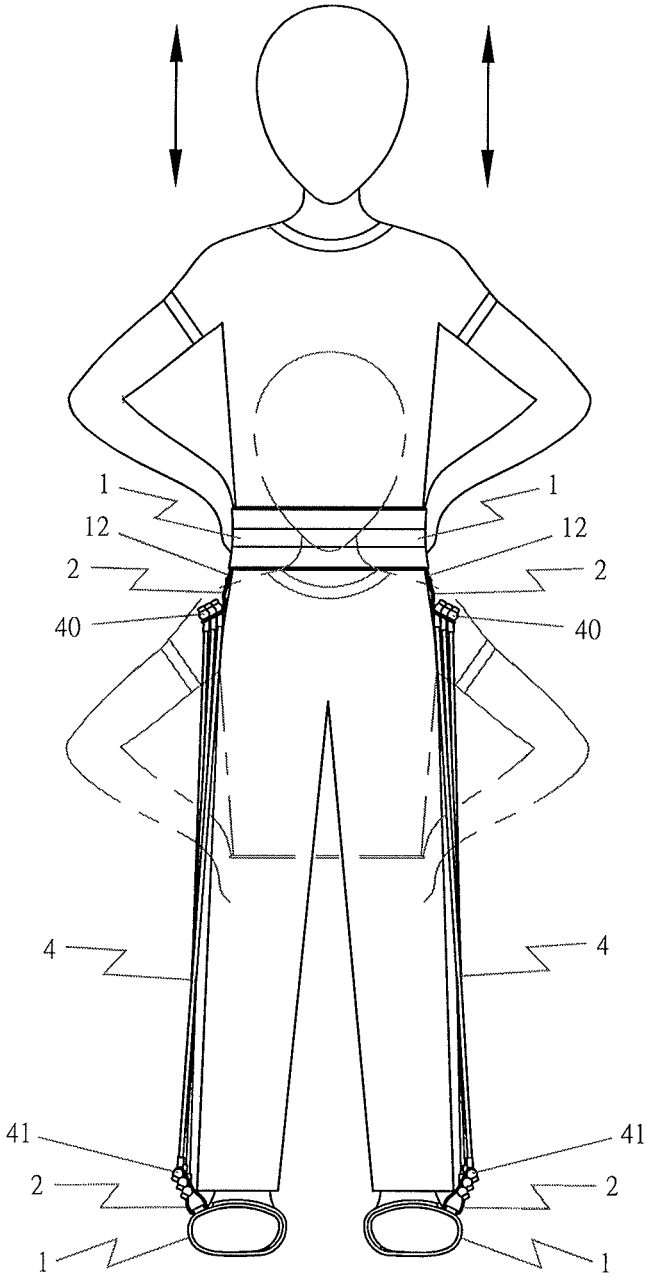
FIG. 13 is a schematic view of the apparatus for exercise, body building and rehabilitation in a second using condition in the present invention.
Figure 14:
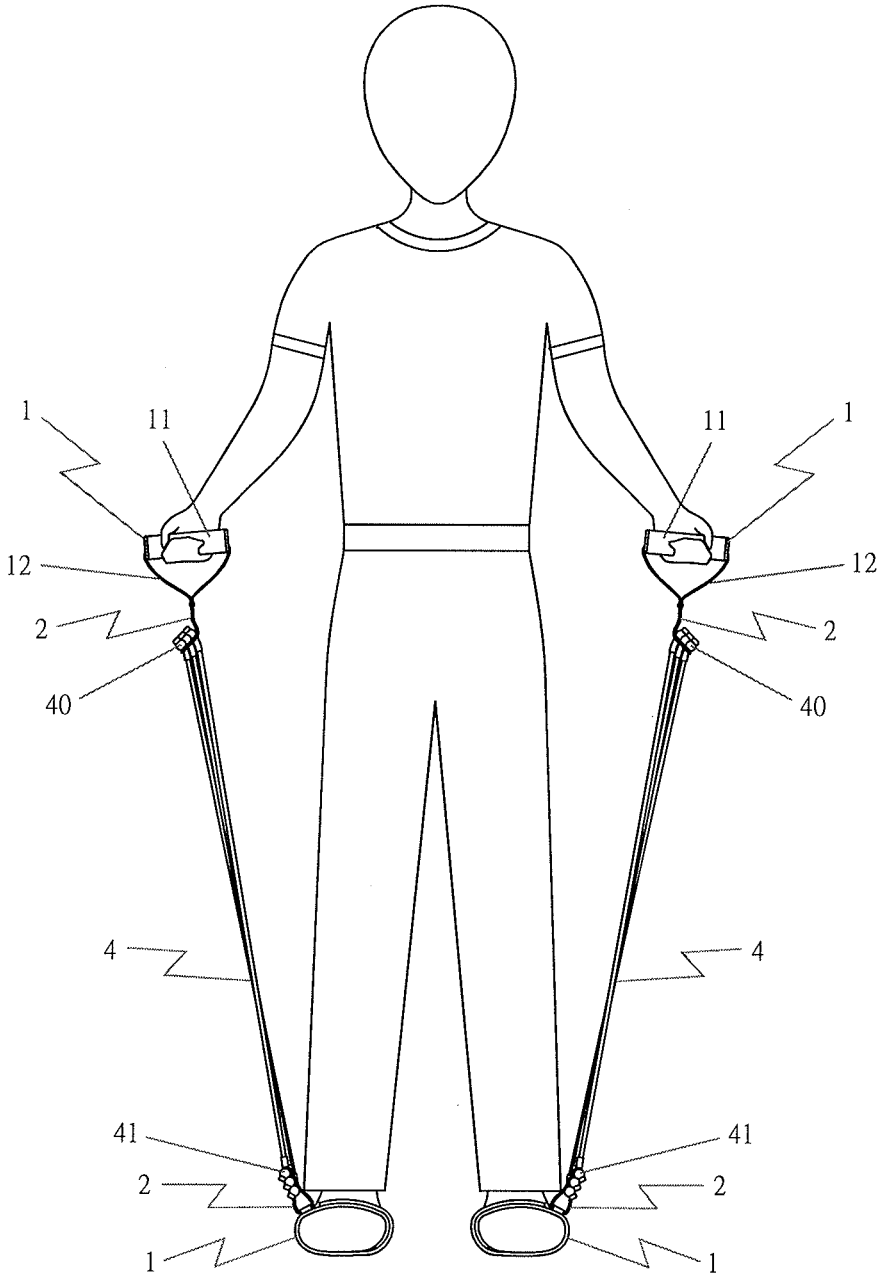
FIG. 14 is a schematic view of the apparatus for exercise, body building and rehabilitation in a third using condition in the present invention.

There are various modes of using such kinds of sports apparatus of this invention. A first mode is to have the main body 1 combined with a proper part of a user's body and then have another end head 41 of the elastic rope 4 firmly clamped on the plank of a door for a user to take exercises, as shown in FIG. 12. A second mode is to have the main body 1 in FIG. 4 bound around a user's waist and have the main body 1 in FIG. 3 bound around the soles of a user's feet and then fix the elastic ropes 4 between the main bodies 1 to enable a user to carry out squatting-and-standing exercises, as shown in FIG. 13. A third mode is to have the main body 1 in FIGS. 5 and 6 grasped by a user hands and have the main body 1 in FIG. 3 combined with the soles of a user's feet and then position the elastic ropes 4 between the main bodies 1 and thus, the user can drag the elastic ropes 4 for carrying out exercises, as shown in FIG. 14. By so designing, the sports apparatus of this invention can be employed for carrying out exercise, body building or rehabilitation anytime and anyplace, easy and convenient in use.

While the preferred embodiments of the invention have been described above, it will be recognized and understood that various modifications may be made therein and the appended claims are intended to cover all such modifications that may fall within the spirit and scope of the invention.

What is claimed is:

1. An apparatus for exercise, body building and rehabilitation comprising:

a main body adapted to be grasped by a user or combined with a part of a user's body; and a fixing member secured with said main body, said fixing member being loop-shaped for fixing an end head of an elastic rope, said elastic rope having said end head and an elongated rope body with said end head having a cross sectional area larger than that of said elongated rope body, said fixing member formed with a first end portion and a second end portion, wherein said fixing member defines an opening, the opening includes a first open hole at said first end portion and a second open hole at said second end portion, said second open hole is narrower than said end head of said elastic rope, but can accommodate said elongated rope body, and said first open hole is larger than said end head of said elastic rope, said first open hole is laterally open and connected to said second open hole via a gradually contracting portion, so that in use said end head of said elastic rope can be put through said first open hole of said first end portion of said fixing member, and then said elastic rope can be moved laterally from said first open hole into said second open hole of said second end portion of said fixing member and stuck therein.

2. The apparatus for exercise, body building and rehabilitation as claimed in claim 1, wherein said main body is an annular belt adapted to be bound around a user's waist, and provided with combining members for combining two ends of said annular belt together, said main body is secured with one fixing member or plural fixing members.

3. The apparatus for exercise, body building and rehabilitation as claimed in claim 2, wherein said main body is able to be widened by adjusting said combining members when said main body is to be bound around a user's leg.

4. The apparatus for exercise, body building and rehabilitation as claimed in claim 2, wherein said main body is able to be widened and lengthened by adjusting said combining members when said main body is to be bound around a user's waist.

5. The apparatus for exercise, body building and rehabilitation as claimed in claim 1, further comprising a connecting member, wherein said fixing member is secured with said main body by said connecting member.

6. The apparatus for exercise, body building and rehabilitation as claimed in claim 5, wherein said connecting member is fixed with said main body by sewing or riveting.

7. The apparatus for exercise, body building and rehabilitation as claimed in claim 1, wherein an included angle § is formed between said first and said second end portions.

8. The apparatus for exercise, body building and rehabilitation as claimed in claim 7, wherein said included angle § formed between said first and said second end portions of said fixing member is larger than 90 degrees and less than 175 degrees.

9. The apparatus for exercise, body building and rehabilitation as claimed in claim 7, wherein said included angle § formed between said first and said second end portions is zero degree.

10. The apparatus for exercise, body building and rehabilitation as claimed in claim 7, wherein said second open hole of said second end portion of said fixing member has an elongated U-shaped cross section, a width of said second open hole is smaller than said end head of the elastic rope and larger than that of said elongated rope body, and a length of said second open hole is sufficiently long to hold several end heads of plural elastic ropes.

11. The apparatus for exercise, body building and rehabilitation as claimed in claim 1, wherein said second open hole of said second end portion of said fixing member is equal to or longer than or shorter than said first open hole of said first end portion in length.

* * * * *